US006557372B1

(12) United States Patent
Ozawa et al.

(10) Patent No.: US 6,557,372 B1
(45) Date of Patent: May 6, 2003

(54) REFRIGERATING UNIT HAVING PLURAL AIR COOLED CONDENSERS

(75) Inventors: Toru Ozawa, Irvine, CA (US); Milos Vujicic, Fountain Valley, CA (US)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/055,908

(22) Filed: Jan. 28, 2002

(51) Int. Cl.[7] ..... F25B 39/04; F28D 1/00

(52) U.S. Cl. ..... 62/507; 62/498; 165/150; 165/144

(58) Field of Search ..... 62/507, 498, 511, 62/DIG. 17; 165/150, 113, 114, 144

(56) References Cited

U.S. PATENT DOCUMENTS

| | | | | |
|---|---|---|---|---|
| 3,543,843 A | * | 12/1970 | Gunter | 165/113 |
| 4,190,102 A | | 2/1980 | Gerz | 165/113 |
| 4,831,844 A | | 5/1989 | Kadle | 62/507 |
| 6,089,039 A | | 7/2000 | Yamauchi | 62/498 |
| 6,092,377 A | | 7/2000 | Tso | 62/173 |

FOREIGN PATENT DOCUMENTS

| | | | |
|---|---|---|---|
| JP | 10153352 A | * | 6/1998 |
| JP | 11190561 A | * | 7/1999 |

* cited by examiner

*Primary Examiner*—Chen-Wen Jiang
(74) *Attorney, Agent, or Firm*—Paul A. Guss

(57) ABSTRACT

Two differently sized condensers are positioned at respective opposite ends of a refrigerating unit. Other elements, such as a compressor and evaporator, are accommodated between the condensers. Each condenser includes a fan and a serpentine pipe defining a passageway in thermal contact with a plurality of heat transfer fins. The first larger condenser receives the gaseous phase of the refrigerant. As it changes to a liquid phase, the refrigerant passes into the second smaller condenser. The passageway of the second condenser is also smaller in diameter than in the first condenser. The smaller diameter passageway in the second condenser compensates for decrease in volume of the condensing refrigerant, permitting higher velocity flow of liquid refrigerant through the pipe for maintaining a good heat transfer coefficient. The condensers and fans also make efficient use of space inside the unit housing, enabling the size of the unit to be decreased.

8 Claims, 6 Drawing Sheets

REFRIGERATING UNIT HAVING PLURAL AIR COOLED CONDENSERS

BACKGROUND OF THE INVENTION

1. Field of the Invention

The present invention concerns a refrigeration apparatus using plural air cooled condensers, and in particular concerns a condenser design and arrangement of the components of a refrigeration circuit, to result in improved condenser heat transfer, efficient space utilization and noise reduction.

2. Description of the Related Art

The condenser which is used in a refrigerating unit is typically constructed of a single unitary body, having a general rectangular parallelepiped shape, the condenser being made up of piping, through which a refrigerant flows after exiting from a compressor, and heat exchange plates (or fins). A fan is provided for blowing air onto the heat exchange plates as the refrigerant passes through the pipe. As a result, when the refrigerant enters into the condenser from the compressor, it is in a gaseous state and gradually condenses to a liquid state inside the piping of the condenser.

However, when the refrigerant is converted into a liquid state, the volume of the refrigerant decreases dramatically inside the condenser piping. Assuming the internal diameter of the condenser piping remains the same, then due to the decrease in volume, the flow velocity of the refrigerant thus also drops dramatically when the refrigerant changes into a condensed liquid. Moreover, the flow velocity of the refrigerant is a fundamental parameter in determining the heat transfer coefficient of the refrigerant flowing inside the pipe, as well as the overall heat transfer efficiency of the condenser itself.

Various condenser manufacturers have provided designs in which two or three pipes are used at the inlet of an air cooled condenser, wherein midway through the condenser, the pipes are merged together into a single pipe. In this way, the total effective diameter of the condenser piping decreases to compensate for the decrease in volume of the refrigerant in the liquid phase. However, the condenser itself is still a single unit. Because of this, the size of the overall body of the refrigerating unit is basically determined by the size of the air cooled condenser itself, which is the largest single component of the refrigerating unit. Furthermore, when such a large single-body condenser is used, by necessity the fan therefor is also large, with the disadvantage that noise and vibration produced by the refrigerating unit are also quite large.

A condenser design like that described above is disclosed in U.S. Pat. No. 4,831,844 to Kadel. More specifically, in Kadle, a first fin and tube type condenser segment is defined by a dual flow arrangement by connecting an inlet port to a Y-type connector. The incoming refrigerant gas thus flows in parallel pairs of front and back rows of plural tubes. After such a parallel flow, another Y-type connector is used to combine the flows from the plural tubes into a single tube which continues to the outlet of the condenser. However, as indicated above, although two condensing stages are provided, the condenser of Kadle is essentially a single unit, and the condensing stages are not separated into respective condenser units, each having its own fan, in such a way to permit other components of the refrigerating unit (such as the compressor, evaporator, etc.) to be located between respective condenser units.

There have also been arrangements in which two or more condensers are arranged in series, or wherein multiple fans are provided for a single condenser unit, but such arrangements have not provided any improvement in heat transfer efficiency, especially in the liquid phase part of the condenser. Furthermore, these arrangements still provide the condenser section only on one side of the air conditioning unit. Since the condenser size overall is very large, such designs do not make efficient use of the space inside the housing of the refrigerating unit, and an appreciable unused dead space remains inside the unit housing. Thus, the overall size and noise of the unit cannot be decreased by such methods.

Other prior art condensers used in refrigerating units are known as follows.

U.S. Pat. No. 4,190,102 by Gerz shows a condenser installation having first and second heat exchange means, each including parallel flow passages, wherein the output of the first heat exchange means passes to the second heat exchange means. The flows paths in each of the first and second heat exchange means appear to be in parallel rather than in series. Further, steam from a steam conduit is fed to a chamber in the second heat exchange means.

U.S. Pat. No. 6,089,039 by Yamaguchi discloses, in FIGS. 9 and 11 thereof, a refrigerating unit which includes first and second stage condensers which require a crossflow coupling. In the embodiment shown in FIG. 11, the first stage condenser functions as an evaporator during heating, while the second stage condenser functions as a condenser, and thus the first and second condenser stages perform different functions at different times.

U.S. Pat. No. 6,092,377 by Tso discloses a two stage condenser for an air conditioning or refrigeration system. An upper or main heat exchanger coil is cooled by a fan, while a lower condenser coil is cooled by a wind wheel. A partition therebetween defines a laterally directed exhaust port. Again, although two stages are provided, the condenser overall is a single unit and other refrigeration circuit components (i.e., compressor, evaporator, etc.) are not disposed between the condenser stages.

SUMMARY OF THE INVENTION

The present invention is characterized by providing a condenser unit that is divided into two parts, one of which is primarily dedicated to the gas phase of a condensing refrigerant medium, and the other of which is dedicated to the liquid phase of the condensed refrigerant medium. To accommodate this object of the invention, the effective pipe diameter in the second condenser is less than in the first, so that the dimension of the second condenser is also smaller than the first, and moreover, the dimensions of each condenser are decreased in comparison with a single large condenser as known in the prior art. The condensers may be disposed at respective ends of a housing base of the refrigerating unit, with other refrigeration circuit components, i.e., the compressor, evaporator, etc., being disposed between the two condenser sections. Thus, the arrangement results in more efficient use of space and a smaller and quieter refrigerating unit overall.

Because the effective pipe diameter in the second condenser is smaller than in the first, the decreased volume of the refrigerant as it condenses into a liquid is compensated for and the flow velocity of the refrigerant in the liquid phase is kept sufficiently and desirably high. Thus, condenser efficiency, as indicated by the overall heat transfer coefficient (k value) is raised, and at the same time, the refrigerating unit can be designed with a smaller overall size.

Further, because the first and second condensers are smaller than a conventional single-unit condenser, in place of one large fan and fan motor, two smaller fans each having its own motor, are used. As a result, the overall noise produced by the refrigerating unit is actually lower.

The above and other objects, features and advantages of the present invention will become apparent from the following description when taken in conjunction with the accompanying drawings in which a preferred embodiment of the present invention is shown by way of illustrative example.

DETAILED DESCRIPTION OF THE PREFERRED EMBODIMENTS

Figure 1:
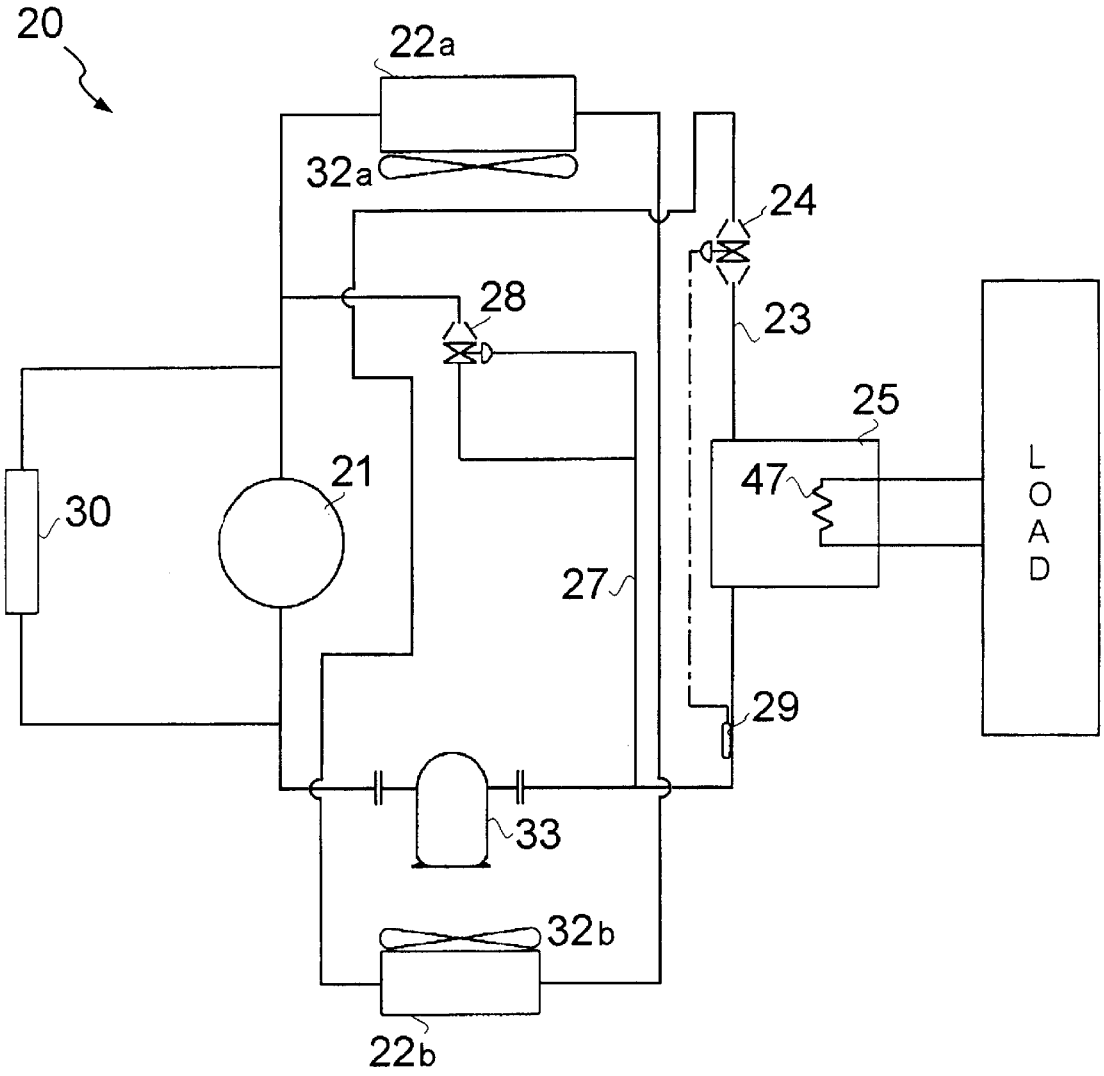
FIG. 1 is a schematic representation of a refrigeration circuit, illustrating the principles of the present invention.

FIG. 1 shows schematically the components of a refrigeration circuit which operates in accordance with the present invention. Such a refrigeration circuit 20 is equipped with a compressor 21, a pair of serially interconnected condensers 22*a* and 22*b*, and a temperature-type expansion valve 24 disposed in series along a refrigerant medium circuit 23 including an evaporator 25 which functions to provide heat exchange with a cooling fluid, for example air or liquid that undergoes heat exchange with the refrigerant circuit, via a heat exchange member 47 in the evaporator 25, the cooling fluid being delivered to a location (indicated by LOAD in FIG. 1) where a controlled temperature is required. A hot gas bypass conduit 27 is provided into which a hot gas that is compressed by the compressor 21 can flow, bypassing the first and second condensers 22*a*, 22*b* and the expansion valve 24 when the compressor 21 is operating under certain load conditions or upon startup, as is well understood in the art. The degree of opening of the aforementioned temperature-type expansion valve 24 is controlled by a temperature sensing bulb 29. Driving of the compressor 21 is controlled by a high/low pressure switch 30, and the flow amount of hot gas flowing through the bypass conduit 27 is controlled by a capacity adjusting hot gas bypass valve 28, respectively. An oil separator 33 comprising a suction tank may also be provided in a known manner.

As indicted schematically in FIG. 1, the condenser unit is made up of separate, serially connected first and second condensers 22*a* and 22*b*. As shall be discussed in greater detail below, the first and second condensers 22*a* and 22*b* are adapted to handle different stages during condensing of the refrigerant medium as it exits from the compressor 21 in a gaseous state and changes to a liquid state. Moreover, the first and second condensers 22*a*, 22*b* are different in size, each condenser having its own fan 32*a* and 32*b*, such fans also being of different size and capacity. The first and second condensers 22*a*, 22*b* are located on respective opposite sides of the refrigeration circuit 20, such that the other (non-condenser) components making up the refrigeration circuit 20 are located in between the first and second condensers 22*a*, 22*b* as shown.

Figure 2:
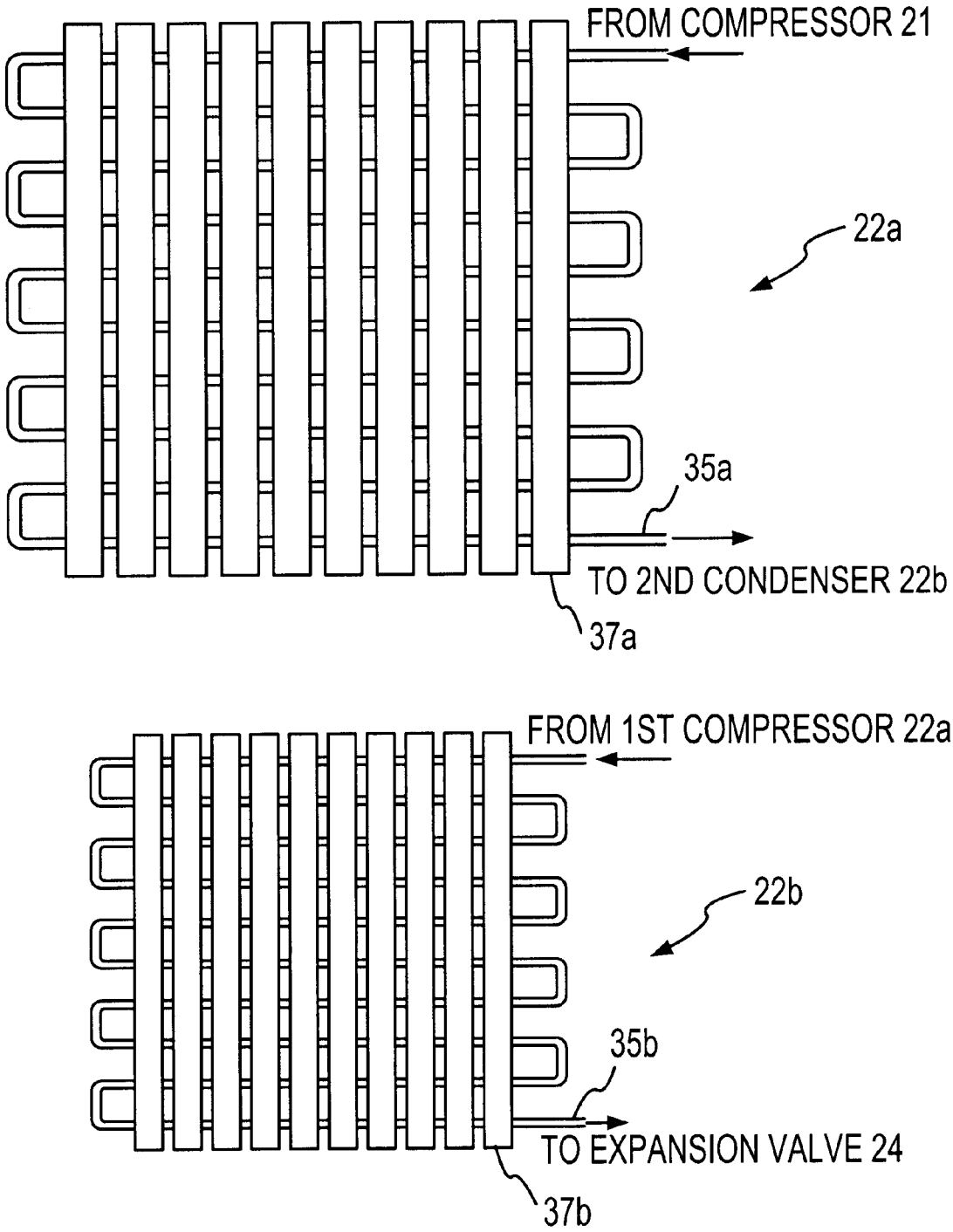
FIG. 2 is a partial schematic representation to show the basic structure of the plural condenser units used in the present invention.

The basic structure of the first and second condensers 22*a* and 22*b* is shown schematically in FIG. 2. As shown, each of the condensers 22*a*, 22*b* essentially consists of a serpentine pipe 35*a*, 35*b* which traverses through a plurality of heat exchange plates of fins 37*a* and 37*b*. Further, fans 32*a*, 32*b* (not shown in FIG. 2) having suitable size and output capacity matching the size of the respective condensers are provided for blowing air onto the heat exchange plates or fins 37*a*, 37*b*. The first condenser 22*a* is larger in size than the second condenser 22*b*, and the condensers 22*a*, 22*b* are connected together in series, such that the outlet of the compressor 21 leads to the inlet of the first condenser 22*a*, and the outlet of the second condenser 22*b* leads to the inlet of the temperature type expansion valve 24. Importantly, the pipe 35*b* in the second condenser 22*b* has a smaller internal diameter than the pipe 35*a* of the first condenser 22*a*, the smaller internal diameter accommodating the reduced volume of the liquid phase of the refrigerant. To achieve the same effect, while preventing pressure loss in the first condenser 22*a*, in place of a single larger diameter pipe in the first condenser 22*a*, it is possible to provide a plurality of parallel running smaller diameter pipes (for example two pipes), which then merge with the single smaller diameter pipe 35*b* provided in the second condenser 22*b*. It is also possible to provide more than two pipes in parallel in the first condenser, and two or more parallel pipes in the second condenser. Thus, as used in the claims, the term "effective internal diameter" of the condenser pipes shall imply the total internal diameter of all pipes used is the condensers 22*a*, 22*b*, in the case that more than one pipe is used for the first condenser 22*a* and/or the second condenser 22*b*. The larger of the condensers (first condenser) 22*a* has width and height dimensions w and h (see FIG. 5) which essentially determine the width and height of the overall refrigerating unit body, as shall become apparent in the subsequent descriptions.

Figure 3:
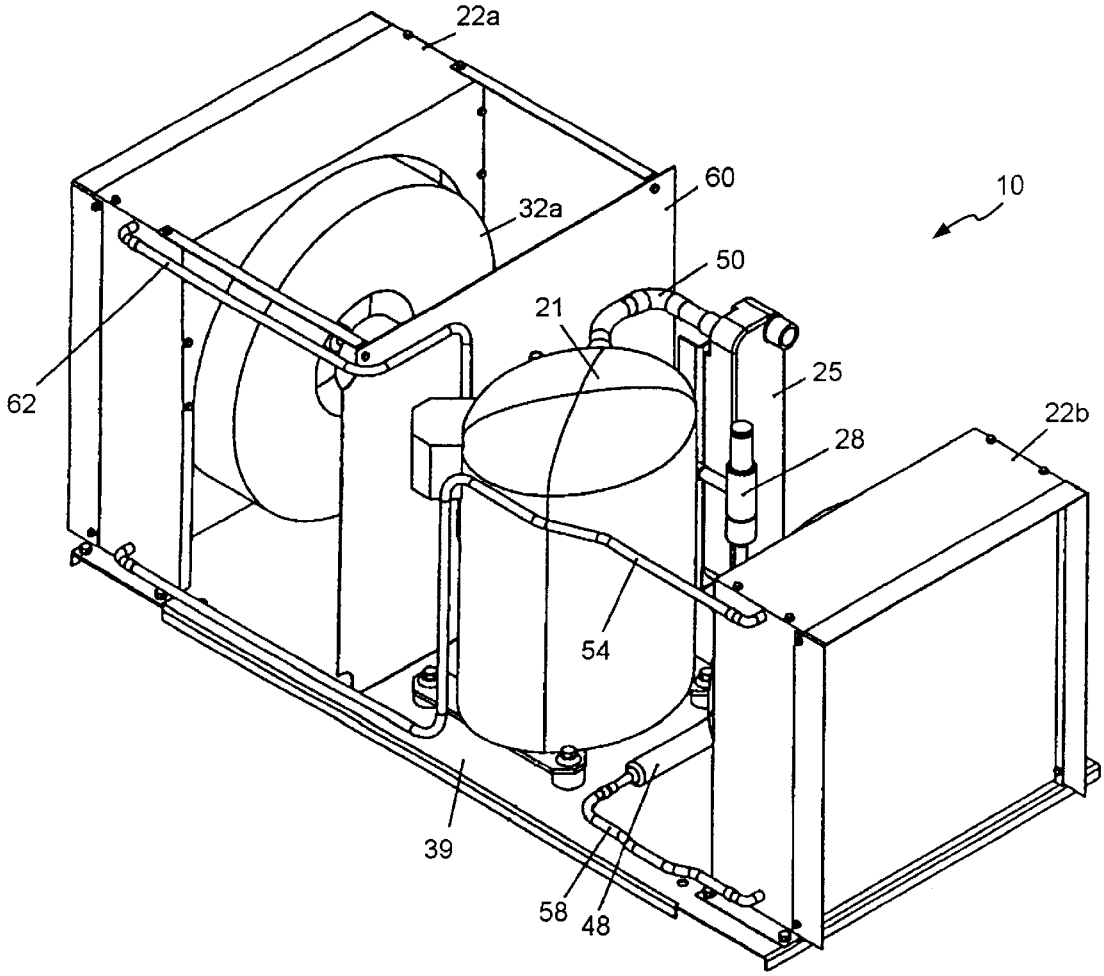
FIG. 3 is a perspective view of the refrigerating unit of the present invention.
Figure 4:
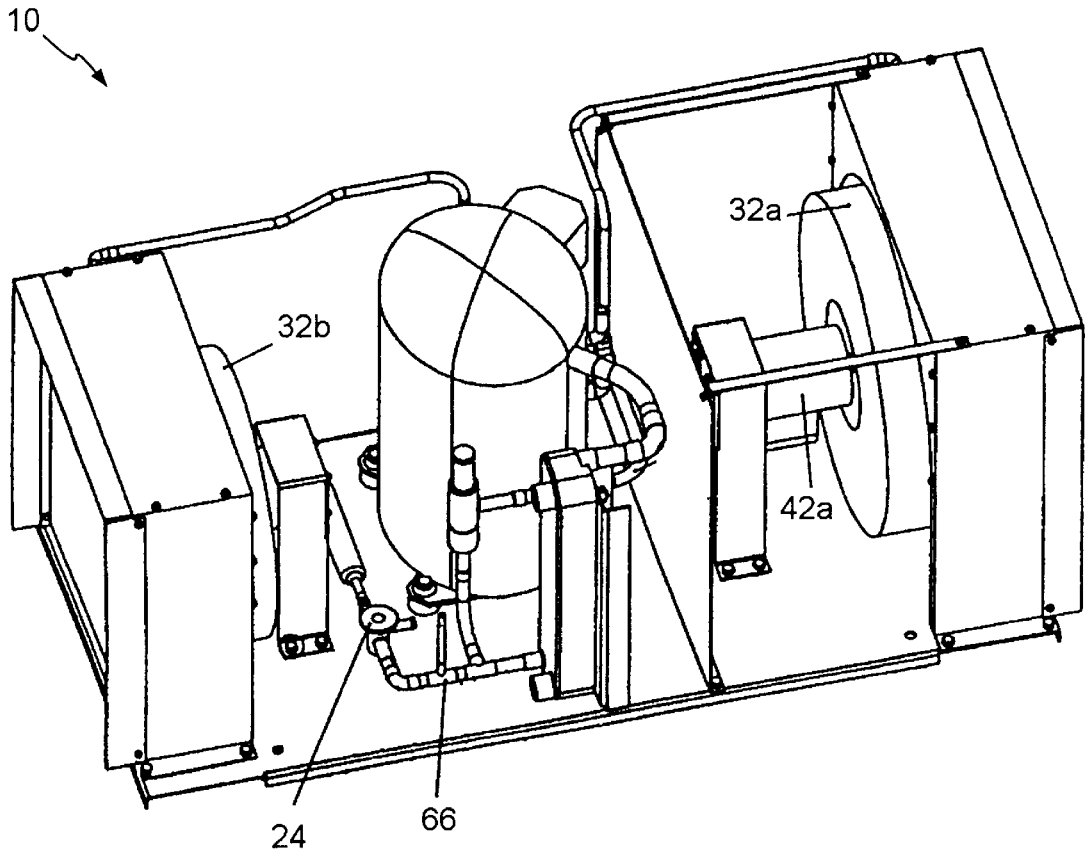
FIG. 4 is a perspective view of the refrigerating unit of the present invention, taken from a different viewing angle.

Referring now to FIGS. 3 and 4, the refrigerating unit of the present invention is denoted generally by reference numeral 10, and includes, among other conventional elements of the refrigeration circuit, a compressor 21 and an evaporator 25. Condenser units 22*a* and 22*b* are supported on a rectangular housing base 39, at respective opposite ends thereof. Each of the condenser units 22*a*, 22*b* is constructed essentially as shown in FIG. 2, and includes serpentine piping traversing through a plurality of heat transfer plates or fins 37*a* and 37*b*. Condenser 22*a* has a fan 32*a* contiguous thereto, while condenser 22*b* is also provided with a fan 32*b* contiguous thereto. Tubing sections 50, 54, 58, 62 and 66, made for example from copper tubing, are connected together as illustrated, for interconnecting the respective major components of the refrigeration circuit. A hot gas bypass valve is denoted by reference numeral 28. The expansion valve 24 is coupled to a filter drier 48. A first fan motor 42*a*, associated with the larger condenser (first condenser) 22*a*, is supported on the housing base 39 by a bracket 68 for operating the first fan 32*a*. A second, typically lower power, fan motor 42*b* (see FIG. 5) associated with the smaller condenser (second condenser) 22*b* is supported by a bracket 70 mounted on the housing base 39, for operating the second fan 42*b*. A separator plate 60, also mounted on the base 39, divides the space between the first and second condensers 22*a* and 22*b*.

Figure 5:
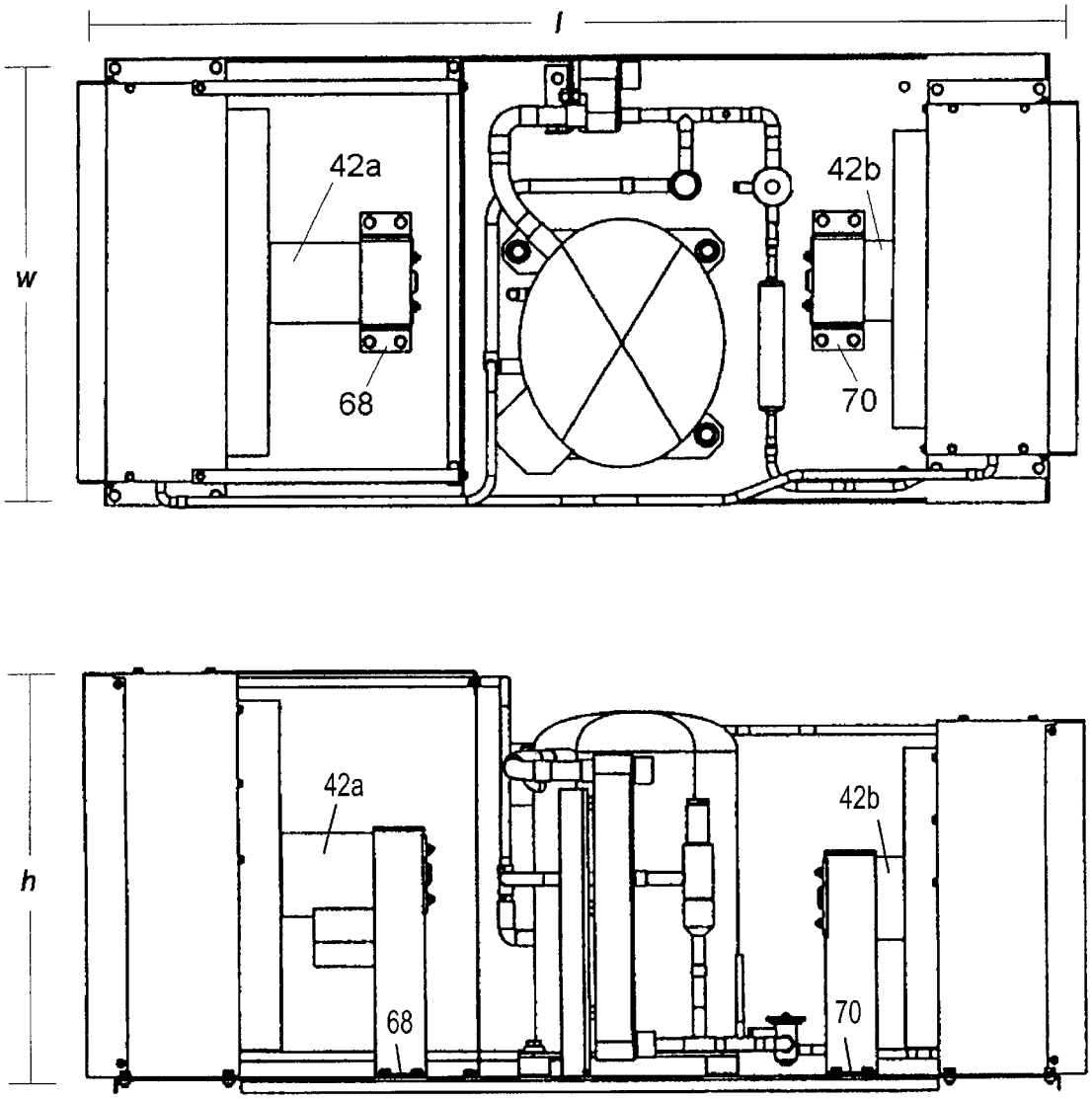
FIG. 5 shows top elevation and side orthogonal views, respectively, of the refrigerating unit of the present invention.

Referring to FIG. 5, the refrigerating unit 10 can be accommodated within a housing (not shown) having side walls for covering the internal elements of the unit 10. Therefore, the unit 10 has width and height dimensions w and h which essentially correspond to the dimensions of the larger condenser (first condenser) 22*a,* and a length dimension 1 extending between ends of the first and second condensers 22*a* and 22*b.*

It is also understood from FIGS. 3, 4 and 5 that the other major components of the refrigerating unit 10, apart from the condensers 22*a* and 22*b,* are located between the first and second condensers, such that the condensers 22*a* and 22*b* are disposed at respective opposite ends of the refrigerating unit 10. Therefore, the space inside the housing (i.e., walls) of the refrigerating unit 10 is very efficiently utilized with hardly any remaining dead space. As a result, the overall size of the refrigerating unit 10 can be small and compact, when compared to conventional single condenser refrigerating units.

Principles of operation of the invention shall now be explained.

It is to be noted that when 1 cc of a liquid (e.g., water) at STP changes into a gas, the resulting volume is 22.41 liters, which represents a 22410 times increase in volume in changing from a liquid to a gas. A similar phenomenon is noticed, in the case of an $R_{134}$ refrigerant, from the fact that in a gaseous state the specific weight of the refrigerant is about 1.97 lbs/ft$^3$, whereas in the liquid state, the specific weight is about 75.387 lbs/ft$^3$, representing a multifold increase in density.

As a result, in condensing from a gas to a liquid state, if the internal diameter of the condenser pipe does not change, it is easy to understand that the fluid velocity inside the pipe will decrease significantly when the refrigerant gas condenses into a liquid. As shall be explained later, this decrease in flow velocity causes the heat transfer coefficient of the refrigerant liquid to be lower than desired. Thus, by decreasing the internal pipe diameter in the second condenser 22*b,* which is dedicated to the liquid phase, the flow velocity of the condensed liquid can be kept sufficiently high, which in turn improves the individual heat transfer coefficient value ($\alpha_2$) inside the pipe.

Stated otherwise, an important aim of the present invention is to increase the overall heat transfer coefficient k of an air cooled condenser, by improving the individual heat transfer coefficient of the liquid phase of the refrigerant in the second condenser 22*b.*

Figure 6:
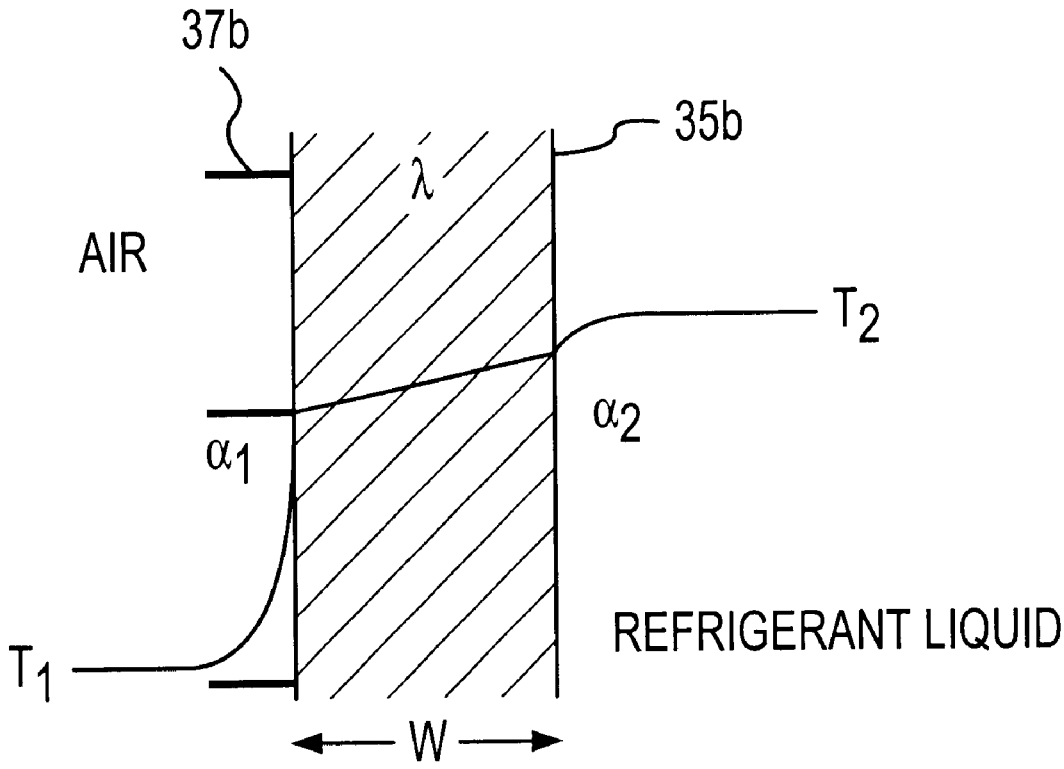
FIG. 6 is a graph illustrating the principles for calculation of the overall heat transfer coefficient k in the second condenser unit of the present invention.

Referring to FIG. 6, a graph is shown illustrating the principles for calculation of the overall heat transfer coefficient k in the second condenser unit of the present invention.

More specifically, the wall of the piping 35*b* in the second condenser 22*b* has a certain width W as shown. On an exterior side of the wall, heat conducting fins 37*b* of the second condenser 22*b* are shown schematically. The value $\alpha_1$ (in units of kcal/m$^2$h° C.) indicates the individual heat transfer coefficient of air, and the value $\alpha_2$ (kcal/m$^2$h° C.) indicates the individual heat transfer coefficient of the refrigerant liquid flowing inside the pipe of the second condenser 22*b.* Moreover, the wall of the condenser pipe possesses a thermal conductivity (represented in units of kcal/mh° C.), wherein the fins are intended to increase the effective thermal conductivity $\lambda$ of the pipe wall. The bold curve shown on either side of, and passing through, the wall indicates the progressive temperature change from a temperature $T_1$, of the air on the outside of the pipe to the temperature $T_2$ of the refrigerant liquid on the inside of the condenser.

Under these conditions, it will be understood that the overall heat transfer coefficient k is calculated according to the following equation.

$$\frac{1}{k} = \frac{1}{\alpha_1} + \frac{w}{\lambda} + \frac{1}{\alpha_2} \tag{1}$$

It is also known that the individual heat transfer coefficient $\alpha_2$ of the liquid refrigerant is several times higher than the individual heat transfer coefficient $\alpha_1$ of air on the outside of the pipe. In the case of a liquid state $R_{134}$ refrigerant, although varying conditions are possible, for purposes of this illustration, when the internal diameter of the second condenser pipe is decreased in accordance with the present invention, the individual heat transfer coefficient $\alpha_2$ can be considered to be about 3000, whereas the individual heat transfer coefficient $\alpha_1$ for air at STP is known to be about 60, and the wall thermal conductivity $\lambda$ for a typical copper condenser pipe is about 327.

Therefore, assuming these values and a wall thickness w of about 1 mm (0.001 m), an example calculation results in an overall heat transfer coefficient k as follows:

$$k_{(present\ invention)}=1/[1/60+0.001/327+1/3000]$$

and since the middle term in this case is negligibly small, the overall heat transfer coefficient k is basically determined by first and third terms, namely, $$k_{(present\ invention)}=1/[1/60+1/3000]\approx 60\ \text{kcal/m}^2\text{h}^\circ\ \text{C.}$$

It is also noted, however, that since the individual heat transfer coefficient $\alpha_2$ for the refrigerant liquid is significantly higher than the individual heat transfer coefficient $\alpha_1$ for air, it has been thought difficult to make substantial improvements in the overall heat transfer coefficient k simply by addressing conditions of the liquid inside the pipe.

Therefore, conventionally it has been thought, in the case of an air cooled condenser, that the efficiency, in terms of the overall heat transfer coefficient k, tends to be poor because the individual heat transfer coefficient of air $\alpha_1$ at the outside of the pipe is low, and therefore efforts at improving the overall k value have typically focused on improving condenser fin design and the like.

However, as a result of investigations conducted by the present inventors, it was discovered that the individual heat transfer coefficient of the refrigerant liquid $\alpha_2$ inside the piping of conventional condensers is also quite poor, owing to the fact that the flow velocity of the fluid inside of the condenser piping decreases along with its volume when the refrigerant changes to a liquid state.

More specifically, the flow velocity v of a fluid is a highly significant parameter for determining the individual heat transfer coefficient of a fluid, as shown by the following known heat transfer relationship.

$$\alpha = \left[\frac{Nu}{Re \cdot Pr}\right] c_p \lambda v \tag{2}$$

where $\alpha$ is the individual heat transfer coefficient of the fluid, Nu is the Nusselt number, Re is the Reynolds number, Pr is the Prandtl number, $c_p$ is the specific heat, $\lambda$ is the thermal conductivity, and v is the fluid velocity. The positive impact of fluid velocity v on the on the individual heat transfer coefficient $\alpha$ of the refrigerant fluid inside the pipe is therefore readily visible from Equation 2.

In the conventional condenser arrangement, when the internal diameter is not restricted during the liquid phase, the individual heat transfer $\alpha_2$ coefficient of the liquid refrigerant, due to its decrease in volume and commensurate drop in flow velocity, can decrease precipitously to as much as 60 during the liquid phase (instead of 3000 as in the present invention), leading to an overall heat transfer coefficient k of only 30 kcal/m$^2$h° C. according to equation (1).

$$k_{(conventional\ design)}=1/[1/60+1/60]=30\ \text{kcal/m}^2\text{h}^\circ\ \text{C.}$$

By decreasing the internal pipe diameter in a separate second condenser 22*b,* and focusing on the liquid phase of the condensing step, the flow velocity during the liquid phase of the condensing refrigerant is improved, and along therewith the individual heat transfer coefficient of the liquid refrigerant $\alpha_2$ inside the pipe is significantly increased and, as a result, the overall heat transfer coefficient k during the liquid phase is improved.

Effect of the Invention

Summarizing, a main point of understanding in the present invention is that the individual heat transfer coefficient of the liquid refrigerant $\alpha_2$ depends on the flow velocity of the liquid inside the pipe. If the flow velocity goes does, as a result of the liquid compressing within the same amount of volume in the pipe (i.e., assuming the internal pipe diameter is not decreased in the liquid phase), then $\alpha_2$ also goes down, resulting in the overall heat transfer coefficient k being lower than desirable. To obtain a higher k value, and hence better efficiency, the pipe diameter is decreased in the liquid phase, so that the flow velocity of the refrigerant in the second condenser 22*b* does not decrease, and therefore $\alpha_2$ remains high. On the other hand, the individual heat transfer coefficient of air $\alpha_1$ is generally always poor, so there is little one can do about it except for trying to improve fin design and the like of the condenser exterior. In the present invention, by focusing especially on the liquid phase, and providing a separate second condenser body 22*b* tailored in size and with a smaller effective pipe diameter, the overall k value is improved over conventional condensers.

A typical 5 kW single-body condenser is about 16×16 inches in size. According to the teachings and effects of the present invention, when such a conventional condenser is replaced, for example, by a 3 kW 14×14 inch condenser and a 2 kW 12×12 condenser, the height and width dimensions of the condenser need be no larger than about 14 inches. Further, since the respective first and second condensers are disposed at respective opposite ends of the refrigerating unit body, dead space is largely eliminated so that the length dimension 1 of the refrigerating unit body can also be reduced. Moreover, the two smaller fan units associated with the condensers actually produce less noise and vibration than a single larger capacity fan.

What is claimed is:

1. A refrigerating unit, comprising:

a compressor;

first and second condensers;

an evaporator;

each of said first and second condensers having an input and an output, wherein a refrigerant passes in series from said first condenser to said second condenser while changing from a gaseous phase to a liquid phase; and first and second fans for blowing air onto heat exchange plates of said first and second condensers, respectively, wherein said compressor, said first and second condensers, and said evaporator are connected in series, with at least one pipe passing through each of said first and second condensers, said at least one pipe in said first condenser having an effective internal diameter larger than that of said at least one pipe in said second condenser.

2. The refrigerating unit according to claim 1, wherein said first condenser is adapted to be traversed by the gaseous phase of said refrigerant and said second condenser is adapted to be traversed by the liquid phase of said refrigerant, wherein said smaller effective diameter of said second condenser compensates for a decrease in volume and flow velocity when said refrigerant changes from said gaseous phase to said liquid phase.

3. The refrigerating unit according to claim 1, wherein said first fan of said first condenser is larger than said second fan of said second condenser.

4. The refrigerating unit according to claim 1, wherein said first and second condensers are positioned at respective opposite ends of a housing base, and said compressor and said evaporator are positioned between said first and second condensers.

5. The refrigerating unit according to claim 4, wherein each of said condensers is of an substantially rectangular parallelepiped shape, a cross-sectional area of said first condenser being greater than that of said second condenser.

6. The refrigerating unit according to claim 4, further comprising an air separator panel located between said first and second condensers.

7. The refrigerating unit according to claim 6, wherein said compressor and said evaporator are positioned between said air separator panel and said second condenser.

8. The refrigerating unit according to claim 6, wherein said first and second condensers lie in respective planes parallel to each other and mutually parallel to said air separator panel.

* * * * *